US008889327B2

(12) United States Patent
Takemori

(10) Patent No.: US 8,889,327 B2
(45) Date of Patent: Nov. 18, 2014

(54) TONER FOR DEVELOPING ELECTROSTATIC IMAGES

(71) Applicant: Kyocera Document Solutions Inc., Osaka (JP)

(72) Inventor: Toshiki Takemori, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/651,582

(22) Filed: Oct. 15, 2012

(65) Prior Publication Data

US 2013/0095423 A1 Apr. 18, 2013

(30) Foreign Application Priority Data

Oct. 14, 2011 (JP) ..... 2011-226682

(51) Int. Cl.
*G03G 9/00* (2006.01)
*G03G 9/08* (2006.01)
*G03G 9/087* (2006.01)

(52) U.S. Cl.
CPC ..... *G03G 9/0821* (2013.01); *G03G 9/08755* (2013.01); *G03G 9/08782* (2013.01); *G03G 9/08793* (2013.01); *G03G 9/08795* (2013.01); *G03G 9/08797* (2013.01)
USPC ..... 430/108.1; 430/108.4; 430/109.4; 430/125.3

(58) Field of Classification Search
CPC ..... G03G 9/08782; G03G 9/08755; G03G 9/08793; G03G 9/08797; G03G 9/08795; G03G 9/0821
USPC ..... 430/94–110.4, 125.3
See application file for complete search history.

(56) References Cited

U.S. PATENT DOCUMENTS

2009/0162762 A1* 6/2009 Maehata et al. ..... 430/48
2011/0033207 A1* 2/2011 Ahn et al. ..... 399/252

FOREIGN PATENT DOCUMENTS

| | | | |
|---|---|---|---|
| JP | 02-053078 | 2/1990 | |
| JP | 2000-292979 | 10/2000 | |
| JP | 2001-265056 | 9/2001 | |
| JP | 2001-305787 | 11/2001 | |
| JP | 2002-221827 | 8/2002 | |
| JP | 2004-151638 | * 5/2004 | ..... G03G 9/09 |
| JP | 2009-133937 | 6/2009 | |

OTHER PUBLICATIONS

English Language Translation of JP 2004-151638, May 27, 2004.*

* cited by examiner

*Primary Examiner* — Christopher Rodee
*Assistant Examiner* — Omar Kekia
(74) *Attorney, Agent, or Firm* — K&L Gates LLP

(57) ABSTRACT

A toner for developing electrostatic images contains a binder resin, a colorant, a release agent, and a charge control agent. The release agent contains a wax having a polar group. The toner for developing electrostatic images has tan δ of 1 to 2 at a temperature of 80° C. to 145° C. as measured with a viscoelasticity measuring apparatus at a frequency of 10 Hz and a shear stress of 500 Pa, and has a breaking point of 180° C. or less in a temperature-tan δ curve.

7 Claims, 3 Drawing Sheets

TONER FOR DEVELOPING ELECTROSTATIC IMAGES

INCORPORATION BY REFERENCE

This application is based upon and claims the benefit of priority from the corresponding Japanese Patent application No. 2011-226682, filed Oct. 14, 2011, the entire contents of which are incorporated herein by reference.

FIELD

The present disclosure relates to toner for developing electrostatic images.

BACKGROUND

In general, in electrophotography, after the uniform charging of a surface of an electrostatic latent image bearing member (photoconductor) using corona discharge, the uniformly charged surface of the electrostatic latent image bearing member is exposed to a laser beam to form an electrostatic latent image on the surface of the electrostatic latent image bearing member. The electrostatic latent image is then developed with toner to form a toner image on the surface of the electrostatic latent image bearing member. The toner image is then transferred to a recording medium to produce a high-quality image. Toners for use in the formation of toner images are generally manufactured by mixing a binder resin, such as a thermoplastic resin, with a colorant, a charge control agent, a release agent, and a magnetic material, and subjecting the mixture to kneading, pulverization, and classification. Such toners have an average particle diameter of 5 to 10 μm. In order to impart flowability to the toner, control the amount of electrostatic charge of the toner, and/or improve removability of a residual toner on a photoconductor after transfer, an inorganic fine powder, such as silica and/or titanium oxide, is added to the toner.

From the perspective of energy conservation and size reduction, there is a demand for toner having excellent low-temperature fixability with minimum heating of a fixing roller. However, toners having excellent low-temperature fixability often contain a binder resin having a low melting point or glass transition point or a release agent having a low melting point. Storage of such toners at high temperature therefore generally causes aggregation of toner particles. Furthermore, toner fused on a heated fixing roller tends to cause high-temperature offset.

Various studies have been performed to solve these problems. One proposed toner has tan δ peak temperatures of 50 to 100° C. and 130 to 180° C. in viscoelasticity measurement at a frequency of 1 Hz and a strain of 0.1.

Although the proposed toner has high storage stability, the toner sometimes cannot be fixed at low temperature or causes offset at high temperature in the image formation with an image-forming apparatus for high-speed printing or an image-forming apparatus having a high fixing pressure (nip pressure). Thus, there is a need for toner that has excellent low-temperature fixability and a reduced likelihood of causing offset at high temperature without adversely affecting the storage stability of the toner.

SUMMARY

A toner for developing electrostatic images according to an embodiment of the present disclosure includes a binder resin, a colorant, a release agent, and a charge control agent. The release agent contains a wax having a polar group. The toner has tan δ of 1 to 2 at a temperature of 80 to 145° C. as measured with a viscoelasticity measuring apparatus at a frequency of 10 Hz and a shear stress of 500 Pa. The toner has a breaking point of 180° C. or less in a temperature-tan δ curve.

Additional features and advantages are described herein, and will be apparent from the following Detailed Description and the figures.

DETAILED DESCRIPTION

Figure 1:
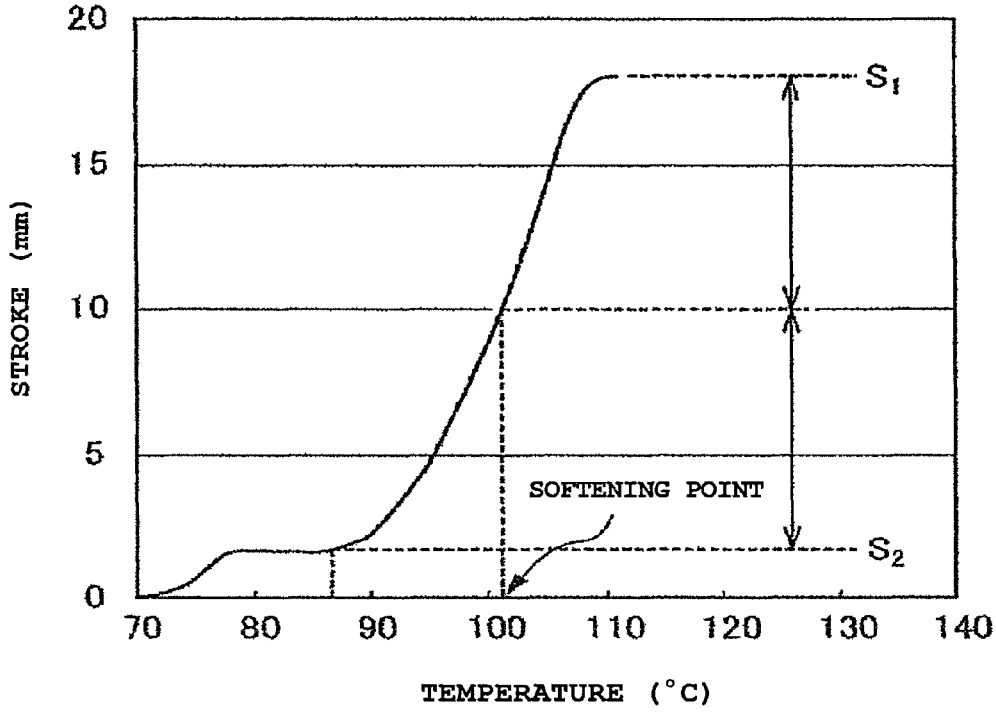
FIG. 1 is a graph showing a measuring method of the softening point of toner measured with an elevated type flow tester.

Embodiments of the present disclosure will be described below. The present disclosure is not limited to these embodiments, and various alterations may be made in these embodiments. To avoid redundancies, explanations will not be repeated. This does not limit the gist of the present disclosure.

In an embodiment of the present disclosure, toner for developing electrostatic images (hereinafter also referred to simply as toner) is provided. The toner includes a binder resin, a colorant, a release agent, and a charge control agent. The release agent contains a wax having a polar group. The toner has tan δ of 1 to 2 at a temperature of 80 to 145° C. as measured with a viscoelasticity measuring apparatus at a frequency of 10 Hz and a shear stress of 500 Pa. The toner has a breaking point of 180° C. or less in a temperature-tan δ curve.

In addition to the binder resin, the colorant, the charge control agent, and the release agent, the toner may further contain a magnetic powder. The toner may be manufactured by melt-kneading the binder resin and various components, pulverizing the mixture to produce toner base particles, and depositing an external additive on the surfaces of the toner base particles. If desired, the toner may be mixed with a carrier and used as a two-component developer. The binder resin, the colorant, the charge control agent, the release agent, the magnetic powder, and the external additive for use in the toner according to this embodiment of the present disclosure will be described below. The carrier for use in the two-component developer will also be described below. A method for manufacturing the toner will also be described below.

Binder Resin

The binder resin may be any binder resin with which a toner having predetermined viscoelastic properties can be manufactured. The binder resin is appropriately selected from resins conventionally used for binder resins for the toners in consideration of the melting point, the glass transition point, the softening point, and other properties. Specific examples of the binder resin include thermoplastic resins, such as styrene resin, acrylic resin, styrene acrylic resin, polyethylene resin, polypropylene resin, vinyl chloride resin, polyester resin, polyamide resin, polyurethane resin, poly(vinyl alcohol) resin, vinyl ether resin, N-vinyl resin, and styrene-butadiene resin. Among these resins, polyester resin is preferred because the melting point and the glass transition point of the polyester resin are easy to control, and the polyester resin facilitates the manufacture of toner having excellent low-temperature fixability and the dispersion of a colorant in toner.

The polyester resin may be produced by polycondensation or copolycondensation of an alcohol component and a carboxylic acid component. The components for use in the synthesis of the polyester resin include divalent, trivalent, or higher valent alcohol components and divalent, trivalent, or higher valent carboxylic acid components.

Specific examples of divalent, trivalent, or higher valent alcohol components include diols, such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, poly(ethylene glycol), poly(propylene glycol), and poly(tetramethylene glycol); bisphenols, such as bisphenol A, hydrogenated bisphenol A, polyoxyethylenated bisphenol A, and polyoxypropylenated bisphenol A; and trivalent or higher valent alcohols, such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the divalent, trivalent, or higher valent carboxylic acid components include divalent carboxylic acids, such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and alkyl and alkenyl succinic acids, including n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid; and trivalent or higher valent carboxylic acids, such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxylic-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and Empol (trade name) trimer acid. These divalent, trivalent, or higher valent carboxylic acid components may be derivatives that can form an ester, such as acid halides, acid anhydrides, and lower alkyl esters. The term "lower alkyl", as used herein, refers to an alkyl group having 1 to 6 carbon atoms.

When the binder resin is a polyester resin, the polyester resin preferably has a softening point of 100 to 130° C., more preferably 100 to 120° C. When the polyester resin has a softening point in these ranges, the toner tends to have excellent low-temperature fixability.

The binder resin is preferably a thermoplastic resin because of its excellent fixability. The thermoplastic resin may be used alone or in combination with a cross-linker or a thermosetting resin. Introduction of a cross-linked structure into the binder resin can improve the storage stability, shape retention, and durability of the toner without deterioration in toner fixability.

The thermosetting resin used in combination with the thermoplastic resin is preferably an epoxy resin or a cyanate resin. Suitable examples of the thermosetting resin include bisphenol A epoxy resin, hydrogenated bisphenol A epoxy resin, novolak epoxy resin, polyalkylene ether epoxy resin, alicyclic epoxy resin, and cyanate resin. The thermosetting resins may be used in combination.

The binder resin preferably has a glass transition point (Tg) of 50 to 65° C., more preferably 50 to 60° C. An excessively low glass transition point of the binder resin may result in the fusion of toner particles within a developing unit of an image-forming apparatus. Deterioration in the storage stability of the toner may result in the fusion of a part of toner particles during transportation of a toner container or storage of a toner container in a warehouse. An excessively high glass transition point may result in deposition of toner on a latent image bearing member (photoconductor) due to the decreased strength of the binder resin. Furthermore, the toner is difficult to fix at low temperature.

The glass transition point of the binder resin can be determined from the point of change in the specific heat of the binder resin measured with a differential scanning calorimeter (DSC). More specifically, the glass transition point of the binder resin can be determined from an endothermic curve of the binder resin obtained with a differential scanning calorimeter (DSC-6200 manufactured by Seiko Instruments Inc.). More specifically, 10 mg of a sample is placed in an aluminum pan, and an empty aluminum pan is used as a reference. The glass transition point of the binder resin can be determined from an endothermic curve of the binder resin obtained in a temperature range of 25 to 200° C. at a heating rate of 10° C./min in an ambient environment of normal temperature and normal humidity.

While the polyester resin used as the binder resin has been described, the binder resin of the toner according to this embodiment of the present disclosure preferably contains a cross-linked polyester resin having a group represented by the chemical formula (1) because the cross-linked polyester resin facilitates the manufacture of a toner having predetermined viscoelasticity. The cross-linked polyester resin may be used alone or as a combination of two or more cross-linked polyester resins.

$$—CO—N< \quad (1)$$

The bond in the chemical formula (1) may be, but is not limited to, an amide bond, a ureide bond, a urethane bond, or an imide bond.

When the binder resin contains the cross-linked polyester resin having the group represented by the chemical formula (1), the binder resin has an increased affinity for a wax including a release agent having a polar group described below. Thus, the binder resin rarely separates from the release agent. This can prevent a softened toner image on a surface of a recorded medium, such as a paper sheet, from separating into layers and depositing on a heated fixing roller during fixing.

The cross-linked polyester contains MEK insoluble material having high elasticity in an amount corresponding to the degree of cross-linking. The MEK insoluble material is insoluble in methyl ethyl ketone (MEK). The MEK insoluble material having high elasticity in the toner can prevent a softened toner image on a surface of a recorded medium from separating into layers on a fixing roller and the recorded medium and depositing on the heated fixing roller.

As described above, the cross-linked polyester resin having the group represented by the chemical formula (1) in the binder resin can prevent a softened toner image on a surface of a recorded medium from separating into layers on a fixing roller and the recorded medium and depositing on the heated fixing roller. This makes it easy to fix the toner at lower temperature and prevent high-temperature offset.

The cross-linked polyester resin will be described below.

Cross-Linked Polyester Resin

The cross-linked polyester preferably has the group represented by the chemical formula (1) in its molecular chain.

—CO—N< (1)

The cross-linked polyester resin may be produced by any known method. The group represented by the chemical formula (1) may be present in the main chain or a cross-linked chain of the cross-linked polyester resin.

The cross-linked polyester resin may have any degree of cross-linking. In the case that the cross-linked chain of the cross-linked polyester resin is introduced by using a cross-linker, the number of moles of the cross-linker is preferably 5 to 30% by mole, more preferably 5 to 20% by mole, still more preferably 5 to 15% by mole, of the number of moles of the monomers of the cross-linked polyester resin including the cross-linker. Use of the binder resin containing the cross-linked polyester resin produced using an amount of cross-linker that facilitates the manufacture of a toner having predetermined viscoelasticity.

The cross-linked polyester resin having the group represented by the chemical formula (1) in its molecular chain may be produced by a reaction between a copolymer and a cross-linker, wherein the copolymer is a copolymer of a carboxylic acid component containing a trivalent or higher valent carboxylic acid component and an alcohol component, and the cross-linker is a bisoxazoline compound having the chemical formula (2).

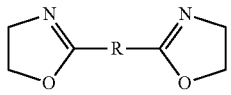

(2)

(wherein R denotes a phenylene group or an alkylene group having 1 to 6 carbon atoms.)

Specific examples of the group R in the chemical formula (2) include a p-phenylene group, a m-phenylene group, an o-phenylene group, a methylene group, a 1,1-ethanediyl group, a 1,2-ethylene group, a 1,3-propanediyl group, a 2,2-propanediyl group, a 1,4-butanediyl group, a 1,5-pentanediyl group, and a 1,6-hexanediyl group.

Because of its high reactivity with a carboxy group, the bisoxazoline compound can satisfactorily introduce a cross-linked chain having a —CONH— linkage into the polyester resin. When the cross-linked polyester resin is produced in this way, the amount of bisoxazoline compound used can be altered to control the degree of cross-linking, which makes it easy to control the MEK insoluble material content.

The glass transition point of the cross-linked polyester resin is not particularly limited and is preferably 140 to 160° C. in terms of low-temperature fixability, more preferably 145 to 155° C. in terms of low-temperature fixability and heat resistance. When a plurality of cross-linked polyester resins are used, the glass transition point of the cross-linked polyester resins is the glass transition point of the cross-linked polyester resins after homogeneous melt-kneading.

The weight-average molecular weight (Mw) of the cross-linked polyester resin is not particularly limited and is preferably 50000 to 100000, more preferably 65000 to 85000, in terms of high elastic force of the toner. The weight-average molecular weight (Mw) of the cross-linked polyester resin may be measured by gel permeation chromatography in accordance with a known method.

The softening point (F1/2) of the cross-linked polyester resin is not particularly limited Typically, the softening point (F1/2) of the cross-linked polyester resin is preferably 130 to 150° C., more preferably 135 to 145° C., in terms of low-temperature fixability. Use of the cross-linked polyester resin having such a softening point facilitates the manufacture of toner having excellent low-temperature fixability, resistance to high-temperature offset, and heat-resistant storage stability (HRSS). The softening point (F1/2) of the cross-linked polyester resin can be measured with a flow tester. A method for measuring the softening point with the flow tester will be described below.

Method for Measuring Softening Point

The softening point (F1/2) of the cross-linked polyester resin is measured with an elevated type flow tester (CFT-500D manufactured by Shimadzu Corp.). Approximately 1.8 g of the cross-linked polyester resin in a sample forming die is pressed at 4 MPa to prepare a cylindrical pellet having a diameter of 1 cm and a thickness of 2 mm. The pellet is placed in the flow tester, and the softening point (Tm) of the cross-linked polyester resin is determined under the following measurement conditions: plunger load=30 kg, die orifice diameter=1 mm, die length=1 mm, heating rate=4° C./min, and measurement temperature range=70 to 160° C. The softening point (F1/2) of the cross-linked polyester resin is determined from a sigmoid curve related to the stroke (mm) and the temperature (° C.) of the cross-linked polyester resin obtained with the flow tester.

The determination of the softening point (F1/2) will be described below with reference to FIG. 1. In the sigmoid curve, the temperature at which the stroke reaches (S1+S2)/2 is considered to be the softening point (F1/2) of the sample, wherein S1 denotes the maximum stroke, and S2 denotes the stroke at the low-temperature baseline.

When the binder resin contains the cross-linked polyester resin having the group represented by the chemical formula (1), the other resin(s) can be appropriately selected from known binder resins for producing toners. The other resin preferably contains no MEK insoluble material so as to facilitate the manufacture of toner having excellent low-temperature fixability and resistance to high-temperature offset. Examples of the resin containing no MEK insoluble material include those having no cross-linked structure in its skeleton, such as poly(vinyl chloride), polyester, polyamide, and poly (ethyl methacrylate). The resin containing no MEK insoluble material is preferably an amorphous polyester resin so as to facilitate the manufacture of toner having excellent low-temperature fixability.

The amorphous polyester resin will be described below.

Amorphous Polyester Resin

The amorphous polyester resin may be produced by a known method using monomers for use in known polyester resins. The amorphous polyester resin has a crystallinity index of 1.1 to 4, preferably 1.5 to 3.0. The crystallinity index of the polyester resin can be appropriately controlled with the type and amount of alcohol component used and carboxylic acid component used as monomers.

The crystallinity index of the amorphous polyester resin is the ratio of the softening point to the temperature corresponding to the maximum heat of fusion. The softening point (F1/2) of the polyester resin is measured with the flow tester described above. The temperature corresponding to the maximum heat of fusion is measured with the differential scanning calorimeter (DSC) described above.

The amorphous polyester resin is produced while the crystallization of the polyester resin is suppressed. A method for suppressing the crystallization of the polyester resin is preferably, but not limited to, one of the methods 1) to 3) described below.

1) A method involving the use of only a little or no alcohol component and only a little or no carboxylic acid component that promotes crystallization.
2) A method involving the use of two or more alcohol components and two or more carboxylic acid components.
3) A method for reducing crystallization, involving the use of an alkylene oxide adduct of bisphenol A or an alkyl-substituted succinic acid.

In the method 1) for reducing crystallization, the alcohol component that promotes crystallization is an aliphatic diol having 2 to 8 carbon atoms, and the carboxylic acid component that promotes crystallization is an aliphatic dicarboxylic acid having 2 to 16 carbon atoms.

Among these methods, the method 3) for reducing crystallization is preferred because the method 3) requires a smaller number of types of monomers and can easily yield an amorphous polyester resin. In the method 3), crystallization tends to decrease with an increase in the amounts of alkylene oxide adduct of bisphenol A used and alkyl-substituted succinic acid used. The amounts of these monomers used are appropriately adjusted in consideration of the degree of crystallinity and other physical properties of the resulting polyester resin.

The amorphous polyester resin may be used alone or as a combination of two or more amorphous polyester resins.

The glass transition point of the amorphous polyester resin is not particularly limited and is preferably 50 to 60° C., more preferably 52.5 to 57.5° C., in terms of low-temperature fixability and heat resistance. When a plurality of amorphous polyester resins are used, the glass transition point of the amorphous polyester resins is the glass transition point of the amorphous polyester resins after homogeneous melt-kneading. The glass transition point of the amorphous polyester resin can be measured with the differential scanning calorimeter (DSC) described above.

The weight-average molecular weight (Mw) of the amorphous polyester resin is not particularly limited and is preferably 2000 to 8000, more preferably 4000 to 6000, in terms of low-temperature fixability and mechanical strength. The weight-average molecular weight (Mw) of the amorphous polyester resin may be measured by gel permeation chromatography in accordance with a known method.

The softening point (F1/2) of the amorphous polyester resin is not particularly limited provided that the objects of the present disclosure can be achieved. The softening point (F1/2) of the amorphous polyester resin is preferably 80 to 100° C., more preferably 85 to 95° C., in terms of low-temperature fixability. Use of the amorphous polyester resin having such a softening point (F1/2) facilitates the manufacture of toner having excellent low-temperature fixability, resistance to high-temperature offset, and heat-resistant storage stability. The softening point (F1/2) of the amorphous polyester resin can be measured in the same manner as the softening point of the cross-linked polyester resin.

The amounts of cross-linked polyester resin used and amorphous polyester resin used in the binder resin are not particularly limited. When the binder resin contains the cross-linked polyester resin and/or the amorphous polyester resin, the content of the methyl ethyl ketone (MEK) insoluble material (% by mass) in the binder resin as measured by a method described below can be adjusted with the amount of cross-linked polyester resin used. The content of the MEK insoluble material in the binder resin is not particularly limited and is preferably 15 to 50% by mass of the mass of the binder resin. Thus, the amount of cross-linked polyester resin used is preferably adjusted such that the content of the MEK insoluble material in the binder resin is in this range with the content of the MEK insoluble material in the cross-linked polyester resin taken into consideration. A method for measuring the content of the MEK insoluble material in the binder resin will be described below.

Method for Measuring MEK Insoluble Material Content 2.0 g of a binder resin is immersed in 100 ml of methyl ethyl ketone (MEK) at 25° C. for 24 hours. The sample is then passed through a glass filter (aperture standard 11G-3). The supernatant liquid of the resulting filtrate is collected. The supernatant liquid may be collected after the filtrate is left still for approximately 12 hours or with a centrifuge to remove a small amount of solids. The supernatant liquid is then dried at 60° C. under vacuum, and the residue after drying is weighed. The MEK insoluble material content of the binder resin is calculated using the following equation from the mass of the binder resin before immersion in MEK and the mass of the residue after drying.

Content of the MEK insoluble material=(mass of binder resin before immersion in MEK−mass of residue after drying)/(mass of binder resin before immersion in MEK)×100

In the measurement of the content of the MEK insoluble material, when a plurality of resins are used as the binder resin, these resins are preferably homogeneously mixed and formed into a fine powder. Such a binder resin may be produced in the same manner as toner base particles described below.

An excessively large or small amount of cross-linked polyester resin used, that is, an excessively high or low content of the MEK insoluble material may result in poor low-temperature fixability of the toner.

Colorant

The toner for developing electrostatic images according to this embodiment of the present disclosure contains a colorant in the binder resin. The colorant in the toner is appropriately selected from known pigments and dyes in a manner that depends on the color of the toner particles. Suitable examples of the colorant in the toner include black pigments, such as carbon black, acetylene black, lampblack, and aniline black; yellow pigments, such as chrome yellow, zinc yellow, cadmium yellow, yellow iron oxide, mineral fast yellow, nickel titan yellow, Naples yellow, naphthol yellow S, Hansa yellow G, Hansa yellow 10G, benzidine yellow G, benzidine yellow GR, quinoline yellow lake, permanent yellow NCG, and tartrazine lake; orange pigments, such as chrome orange, molybdenum orange, permanent orange GTR, pyrazolone orange, vulcan orange, and indanthrene brilliant orange GK; red pigments, such as colcothar, cadmium red, red lead, cadmium mercury sulfide, permanent red 4R, Lithol red, pyrazolone red, watching red calcium salt, lake red D, brilliant carmine 6B, eosin lake, rhodamine lake B, alizarin lake, and brilliant carmine 3B; violet pigments, such as manganese violet, fast violet B, and methyl violet lake; blue pigments, such as Prussian blue, cobalt blue, alkali blue lake, Victoria blue partially chlorinated product, fast sky blue, and indanthrene blue BC; green pigments, such as chromium green, chromium oxide, pigment green B, malachite green lake, and final yellow green G; white pigments, such as zinc white, titanium oxide, antimony white, and zinc sulfide; and extender pigments, such as a barite powder, barium carbonate, clay, silica, white carbon, talc, and alumina white. These colorants may be used in combination to provide the desired hue of the toner.

The amount of colorant used is not particularly limited. More specifically, the amount of colorant is preferably 1 to 10 parts by mass, more preferably 3 to 7 parts by mass, per 100 parts by mass of the binder resin.

Charge Control Agent

The toner for developing electrostatic images according to this embodiment of the present disclosure contains a charge control agent. The charge control agent can improve the charging level of the toner and a charge-increasing characteristic, which is indicative of the possibility of achieving a predetermined charging level of the toner in a short period of time, thereby imparting excellent durability and stability to the toner. Development of positively-charged toner requires a charge control agent having positive chargeability, and development of negatively-charged toner requires a charge control agent having negative chargeability.

The charge control agent used in the toner is not particularly limited and may be appropriately selected from known charge control agents for toners. Specific examples of the charge control agent having positive chargeability include azine compounds, such as pyridazine, pyrimidine, pyrazine, o-oxazine, m-oxazine, p-oxazine, o-thiazine, m-thiazine, p-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes of azine compounds, such as azine fast red FC, azine fast red 12BK, azine violet BO, azine brown 3G, azine light brown GR, azine dark green BH/C, azine deep black EW, and azine deep black 3RL; nigrosine compounds, such as nigrosine, nigrosine salts, and nigrosine derivatives; acid dyes consisting of nigrosine compounds, such as nigrosine BK, nigrosine NB, and nigrosine Z; metal salts of naphthenic acids or higher fatty acids; alkoxylated amines; alkyl amides; and quaternary ammonium salts, such as benzyl methyl hexyl decyl ammonium and decyl trimethyl ammonium chloride. Among these charge control agents having positive chargeability, nigrosine compounds are particularly preferred because the nigrosine compounds can provide rapid charging rise. These charge control agents having positive chargeability may be used in combination.

The charge control agent having positive chargeability may also be a resin having a quaternary ammonium salt, a carboxylic acid salt, or a carboxy group as a functional group. More specifically, the charge control agent having positive chargeability may be a styrene resin having a quaternary ammonium salt, an acrylic resin having a quaternary ammonium salt, a styrene-acrylic resin having a quaternary ammonium salt, a polyester resin having a quaternary ammonium salt, a styrene resin having a carboxylic acid salt, an acrylic resin having a carboxylic acid salt, a styrene-acrylic resin having a carboxylic acid salt, a polyester resin having a carboxylic acid salt, a styrene resin having a carboxy group, an acrylic resin having a carboxy group, a styrene-acrylic resin having a carboxy group, or a polyester resin having a carboxy group. The molecular weights of these resins are not particularly limited. These resins may be oligomers or polymers.

Among the resins that can be used as the charge control agent having positive chargeability, a styrene-acrylic resin having a quaternary ammonium salt as a functional group is preferred because the styrene-acrylic resin allows the amount of electrostatic charge to be easily controlled within the desired range. With respect to the styrene-acrylic resin having a quaternary ammonium salt as a functional group, specific examples of preferred acrylic comonomers for copolymerization with styrene include alkyl(meth)acrylates, such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

The quaternary ammonium salt may be derived from dialkylaminoalkyl(meth)acrylate, dialkyl(meth)acrylamide, or dialkylaminoalkyl(meth)acrylamide through a quaternarization process. Specific examples of the dialkylaminoalkyl(meth)acrylate include dimethylaminoethyl(meth)acrylate, diethylaminoethyl(meth)acrylate, dipropylaminoethyl(meth)acrylate, and dibutylaminoethyl(meth)acrylate. Specific examples of the dialkyl(meth)acrylamide include dimethylmethacrylamide. Specific examples of the dialkylaminoalkyl(meth)acrylamide include dimethylaminopropylmethacrylamide. A polymerizable monomer having a hydroxy group, such as hydroxyethyl(meth)acrylate, hydroxypropyl(meth)acrylate, 2-hydroxybutyl(meth)acrylate, or N-methylol(meth)acrylamide may also be used in the polymerization.

Specific examples of the charge control agent having negative chargeability include organometallic complexes and chelate compounds. Preferred examples of the organometallic complexes and the chelate compounds include acetylacetone metal complexes, such as aluminum acetylacetonate and iron (II) acetylacetonate, and salicylic acid metal complexes and salicylic acid metal salts, such as 3,5-di-tert-butyl salicylic acid chromium. Salicylic acid metal complexes and salicylic acid metal salts are more preferred. These charge control agents having negative chargeability may be used in combination.

The amount of charge control agent having positive or negative chargeability used is not particularly limited. Typically, the amount of charge control agent having positive or negative chargeability used is preferably 1.5 to 15 parts by mass, more preferably 2.0 to 8.0 parts by mass, still more preferably 3.0 to 7.0 parts by mass, per 100 parts by mass of the toner. An excessively small amount of charge control agent used may make it difficult to stably charge the toner with predetermined polarity, resulting in an image density of a formed image lower than the desired value or difficulty in maintaining the image density of a formed image for a long time. In such a case, the charge control agent is difficult to uniformly disperse in the toner, which can cause fogging in a formed image or contamination of a latent image bearing member with a toner component. An excessively large amount of charge control agent used may cause an image defect in a formed image due to deterioration in environmental resistance and consequent poor charging in a high temperature and high humidity environment or contamination of a latent image bearing member with a toner component.

Release Agent

The release agent improves the fixability and offset resistance of the toner. The toner for developing electrostatic images according to this embodiment of the present disclosure essentially contains the release agent. The release agent in the toner for developing electrostatic images according to this embodiment of the present disclosure contains wax having a polar group. The amount of wax having a polar group contained in the release agent is not particularly limited. Typically, the wax having a polar group preferably constitutes 80% by mass or more, more preferably 90% by mass or more, still more preferably 100% by mass, of the release agent.

The wax having a polar group may be appropriately selected from known waxes having a polar group for use in toners. The polar group of the wax may be any group in which atom having a high electronegative, such as oxygen, nitrogen, sulfur, or halogen, causes polarization. Specific examples of the polar group include a urethane group, a urea group, an imide group, a carbonate group, an amide group, an ester group, a carboxy group, an imino group, and an amino group. Specific examples of the wax having a polar group include natural ester wax, such as carnauba wax and rice wax, synthetic ester wax, amide wax, and urethane wax. The wax having a polar group may be modified wax produced by introducing a polar group into wax having no polar group, such as olefin wax or paraffin wax.

The amount of release agent used is not particularly limited. The amount of release agent used is preferably 1 to 20 parts by mass, more preferably 1 to 5 parts by mass, per 100 parts by mass of the binder resin. An excessively small amount of release agent used may have an insufficient effect of preventing offset and image smearing. An excessively large amount of release agent used may result in poor storage stability of the toner because of fusion of toner particles.

The amount of wax having a polar group contained in the toner is not particularly limited and is preferably 20 parts by mass or less, more preferably 1 to 10 parts by mass, still more preferably 1 to 5 parts by mass. An excessively large amount of wax having a polar group used may result in poor storage stability of the toner because of fusion of toner particles.

Magnetic Powder

The toner for developing electrostatic images according to this embodiment of the present disclosure may contain a magnetic powder in the binder resin. The type of magnetic powder contained in the toner is not particularly limited. Suitable examples of the magnetic powder include iron oxides, such as ferrite and magnetite; ferromagnetic metals, such as cobalt and nickel; alloys containing iron and/or ferromagnetic metals; compounds containing iron and/or ferromagnetic metals; ferromagnetic alloys subjected to ferromagnetic treatment, such as heat treatment; and chromium dioxide.

The particle diameter of the magnetic powder is not particularly limited. More specifically, the particle diameter of the magnetic powder is preferably 0.1 to 1.0 μm, more preferably 0.1 to 0.5 μm. The magnetic powder having such a particle diameter can be uniformly dispersed in the binder resin.

In order to improve the dispersion of the magnetic powder in the binder resin, the magnetic powder can be treated with a surface-treating agent, such as a titanium coupling agent or a silane coupling agent.

The amount of magnetic powder used is not particularly limited. For one-component developer, the amount of magnetic powder used is preferably 35 to 60 parts by mass, more preferably 40 to 60 parts by mass, per 100 parts by mass of the toner. An excessively large amount of magnetic powder used may result in a lower image density of a formed image than desired in long-term printing or very poor fixability. An excessively small amount of magnetic powder used may cause fogging in a formed image or a lower image density than desired in long-term printing. For the two-component developer, the amount of magnetic powder is used preferably 20 parts by mass or less, more preferably 15 parts by mass or less, per 100 parts by mass of the toner.

External Additive

In order to improve the flowability, storage stability, and removability of the toner for developing electrostatic images according to this embodiment of the present disclosure, an external additive may be deposited on the surfaces of toner base particles. The term "toner base particles", as used herein, refers to particles on which an external additive is to be deposited.

The external additive for use in the toner is not particularly limited and may be appropriately selected from known external additives for toners. Suitable examples of the external additive include silica and metal oxides, such as alumina, titanium oxide, magnesium oxide, zinc oxide, strontium titanate, and barium titanate. These external additives may be used in combination.

The particle diameter of the external additive is not particularly limited and is typically preferably 0.01 to 1.0 μm.

The volume resistivity of the external additive can be adjusted with the thickness of a surface layer of tin oxide and antimony oxide formed on the external additive and the ratio of tin oxide to antimony oxide.

The ratio of the amount of external additive used to the amount of toner base particles is not particularly limited. Typically, the amount of external additive used is preferably 0.1 to 10 parts by mass, more preferably 0.2 to 5 parts by mass, per 100 parts by mass of toner base particles. Use of such an amount of external additive tends to improve the flowability, storage stability, and removability of the toner.

Carrier

The toner for developing electrostatic images may be mixed with a desired carrier and used as a two-component developer. The carrier in the two-component developer is preferably a magnetic carrier.

A suitable carrier for use in the two-component developer containing the toner for developing electrostatic images according to this embodiment of the present disclosure contains a carrier core material coated with a resin. Specific examples of the carrier core material include iron, oxidized iron, reduced iron, magnetite, copper, silicon steel, ferrite, nickel, and cobalt particles; their alloy particles with manganese, zinc, and aluminum; iron-nickel alloy and iron-cobalt alloy particles; ceramic particles, such as titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate particles; high dielectric constant particles, such as ammonium dihydrogen phosphate, potassium dihydrogen phosphate, and Rochelle salt; and resin carriers that contain the magnetic particles described above dispersed in the resin.

Specific examples of the resin covering the carrier core material include (meth)acrylic polymers, styrene polymers, styrene-(meth)acrylic copolymers, olefin polymers, such as polyethylene, chlorinated polyethylene, and polypropylene, poly(vinyl chloride), poly(vinyl acetate), polycarbonate, cellulose resin, polyester resin, unsaturated polyester resin, polyamide resin, polyurethane resin, epoxy resin, silicone resin, fluoropolymers, such as polytetrafluoroethylene, polychlorotrifluoroethylene, and poly(vinylidene fluoride), phenolic resin, xylene resin, diallyl phthalate resin, polyacetal resin, and amino resin. These resins may be used in combination.

The particle diameter of the carrier is not particularly limited and is preferably 20 to 120 μm, more preferably 25 to 80 μm, as measured with an electron microscope.

The apparent density of the carrier is not particularly limited. The apparent density of the carrier depends on the composition and the surface structure of the carrier and is typically preferably 2000 to 2500 kg/m$^3$.

For the two-component developer, the amount of the toner for developing electrostatic images according to this embodiment of the present disclosure is preferably 3 to 20% by mass, more preferably 5 to 15% by mass, of the mass of the two-component developer. When the toner content of the two-component developer is in such a range, a formed image has a suitable image density, and the toner is prevented from being scattered from a developing apparatus, which reduces contamination within an image-forming apparatus and toner deposits on a transfer paper.

Method for Manufacturing Toner for Developing Electrostatic Images

The toner for developing electrostatic images according to this embodiment of the present disclosure has tan δ of 1 to 2 at a temperature of 80 to 145° C. as measured with a viscoelasticity measuring apparatus at a frequency of 10 Hz and a shear stress of 500 Pa and has a breaking point at a temperature of 180° C. or less in a temperature-tan δ curve. The viscoelasticity measurement of the toner for developing electrostatic images according to this embodiment of the present disclosure will be described below.

By way of example, the viscoelasticity of the toner is measured with a viscoelasticity measuring apparatus (Physica MCR301 manufactured by Anton Paar GmbH) using parallel plates having a diameter of 20 mm at a gap of 2 mm, a frequency of 10 Hz, a temperature of 60 to 200° C., a heating rate of 2.5° C./m, and a shear stress of 500 Pa. The toner is formed into a pellet having a diameter of 20 mm and a thickness of 2.1 mm.

Figure 2:
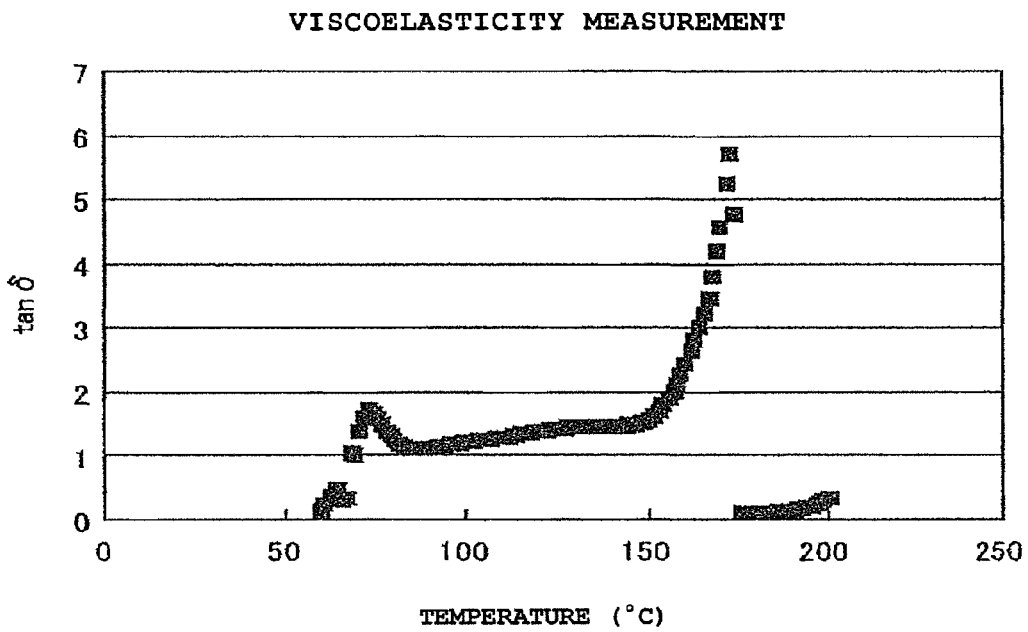
FIG. 2 is a temperature-tan δ curve obtained by the viscoelasticity measurement of toner according to an embodiment.

As illustrated in FIG. 2, tan δ of the toner is determined at different temperatures in viscoelasticity measurement to obtain a temperature-tan δ curve. As illustrated in FIG. 2, tan δ of the toner has its first peak at a glass transition point (Tg). With increasing temperature, tan δ increases gradually, increases rapidly, and decreases discontinuously. One of the two discontinuities at a lower temperature in the temperature-tan δ curve is considered to be a breaking point.

A method for obtaining a toner having the above-mentioned tan δ and breaking point is not particularly limited. For example, the binder resin may be changed to control tan δ and the breaking point temperature.

More specifically, the binder resin may contain a cross-linked polyester resin having a group represented by the chemical formula (1). The cross-linked polyester resin content of the binder resin may be altered, or the degree of cross-linking of the cross-linked polyester resin may be altered, so as to adjust the content of the MEK insoluble material in the binder resin. A decreased content of the MEK insoluble material in the binder resin results in a decreased tan δ and a lowered breaking point temperature. An increased content of the MEK insoluble material in the binder resin results in an increased tan δ and a raised breaking point temperature.

The toner for developing electrostatic images according to this embodiment of the present disclosure may be manufactured by mixing the binder resin with a colorant, a charge control agent, a release agent, and an optional component, such as a magnetic powder, forming toner base particles having the desired particle diameter, and, if desired, depositing an external additive on the surfaces of the toner base particles.

A method for mixing the binder resin with a colorant, a charge control agent, a release agent, and an optional component, such as a magnetic powder, and forming toner base particles is not particularly limited provided that these components can be well dispersed in the binder resin. More specifically, the toner base particles may be formed by mixing the binder resin with a colorant, a release agent, a charge control agent, and a magnetic powder in a mixer, melt-kneading the mixture in a kneader, such as a single- or twin-screw extruder, cooling and pulverizing the kneaded product, and classifying the resulting particles. The average particle diameter of the toner base particles is not particularly limited and is generally preferably 5 to 10 μm.

The external additive may be deposited on the surfaces of the toner base particles by any method. For example, the toner base particles and the external additive are mixed in a mixer, such as a Henschel mixer or a Nauta mixer, such that the external additive is not embedded in the toner base particles.

The toner for developing electrostatic images according to this embodiment of the present disclosure has excellent low-temperature fixability, storage stability, and resistance to high-temperature offset. Thus, the toner for developing electrostatic images according to this embodiment of the present disclosure can be suitably used in various image-forming apparatuses.

Another embodiment of the present disclosure describes a method for forming images with an image-forming apparatus using the toner for developing electrostatic images according to an embodiment. The image-forming apparatus includes a heating roller for heating a recorded medium to which a toner image has been transferred and a pressure roller for pressing the recorded medium. The heating roller is opposite the pressure roller.

Image Forming Method

The image-forming apparatus is not particularly limited and preferably includes a fixing unit, which includes a heating roller and a pressure roller. Under certain fixing conditions, such an image-forming apparatus may have poor low-temperature fixability and cause high-temperature offset. Use of the toner for developing electrostatic images according to an embodiment of the present disclosure, however, results in excellent low-temperature fixability and prevents high-temperature offset. In an embodiment, a tandem color-image-forming apparatus that includes a fixing unit having a heating roller and a pressure roller will be described as an example of the image-forming appratus.

The tandem color-image-forming apparatus includes a plurality of latent image bearing members juxtaposed to each other in a predetermined direction and a plurality of developing units each facing the corresponding latent image bearing member. Each latent image bearing member can have toner images of different color toner on its surface. Each of the developing units includes a roller (developing sleeve) for transporting toner on the surface and supplying the toner to the surface of the corresponding latent image bearing member. Each of the developing units supplies the toner for developing electrostatic images according to an embodiment of the present disclosure to the corresponding latent image bearing member.

Figure 3:
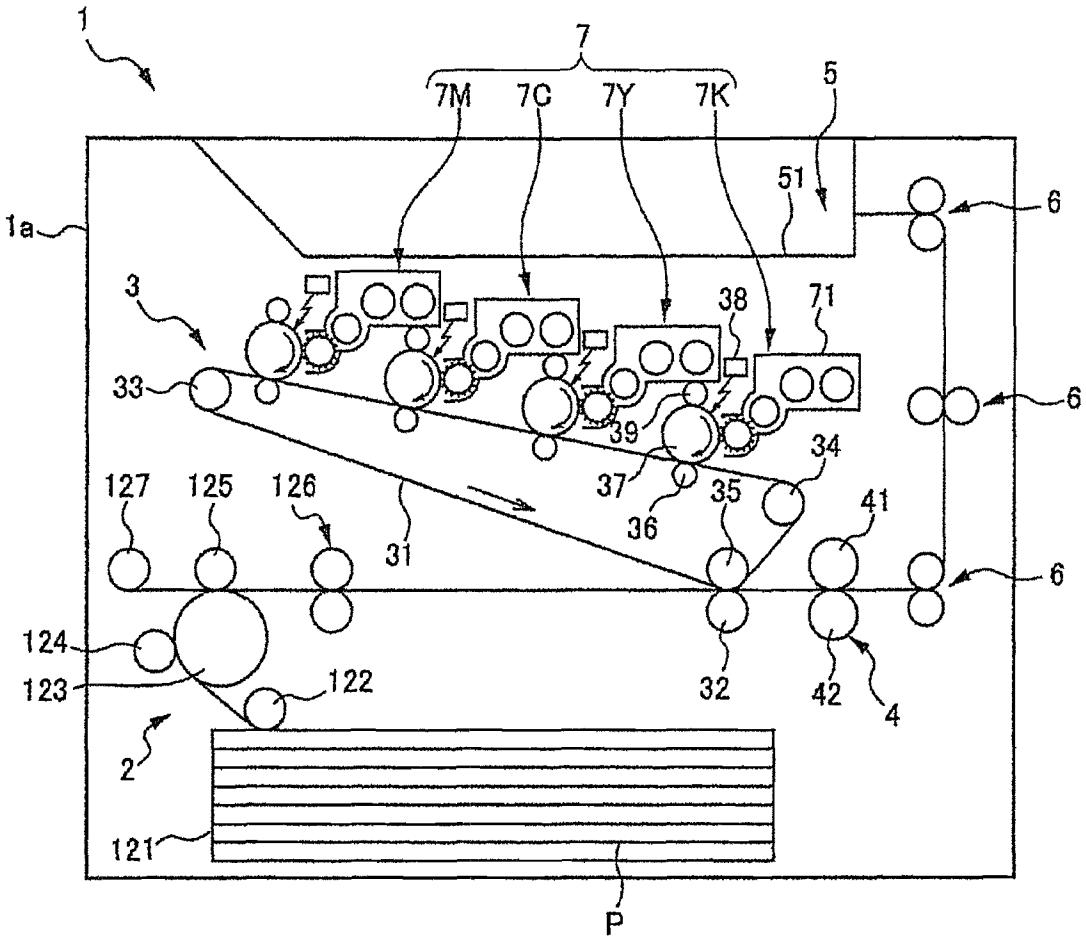
FIG. 3 is a schematic view of an image-forming apparatus.

FIG. 3 is a schematic view of a color printer 1 serving as the image-forming apparatus.

As illustrated in FIG. 3, the color printer 1 includes a box-shaped main body 1*a*. The main body 1*a* includes a paper feeder 2 for feeding a sheet P, an image-forming section 3, and a fixing unit 4. The image-forming section 3 transfers a toner image based on image data to a sheet P while transporting the sheet P fed from the paper feeder 2. The fixing unit 4 fixes an unfixed toner image transferred to the sheet P at the image-forming section 3 onto the sheet P. The main body 1*a* also includes a paper ejecting section 5 on the top surface thereof; to which the sheet P which has undergone fixing process is ejected from the fixing unit 4 after fixing.

The paper feeder 2 includes a paper cassette 121, a pickup roller 122, feed rollers 123, 124, and 125, and a registration roller pair 126. The paper cassette 121 can be inserted into and removed from the main body 1*a* and accommodates sheets P. The pickup roller 122 located at the upper left of the paper cassette 121 can pick up the sheets P from the paper cassette 121 one by one. The feed rollers 123, 124, and 125 can move a sheet P from the pickup roller 122 to a sheet transport path.

The registration roller pair 126 can temporarily hold the sheet P on the sheet transport path from the feed rollers 123, 124, and 125 and feed the sheet P to the image-forming section 3 at a predetermined timing.

The paper feeder 2 further includes a manual feeder (not shown) on the left side of the main body 1*a* and a pickup roller 127 as shown in FIG. 3. The pickup roller 127 can pick up a sheet P from the manual feeder. The sheet P from the pickup roller 127 is moved to the sheet transport path by the feed rollers 123 and 125 and is fed to the image-forming section 3 by the registration roller pair 126 at a predetermined timing.

The image-forming section 3 includes an image-forming unit 7, an intermediate transfer belt 31, and a second transfer roller 32. The image-forming unit 7 can transfer a toner image, based on image data from a computer, to a surface (a contact surface) of the intermediate transfer belt 31. The second transfer roller 32 can transfer the toner image formed on the intermediate transfer belt 31 to a sheet P fed from the paper cassette 121.

The image-forming unit 7 includes a black unit 7K, a yellow unit 7Y, a cyan unit 7C, and a magenta unit 7M from the upstream (the right side in FIG. 3) to the downstream in the direction of movement of the intermediate transfer belt 31. Each of the units 7K, 7Y, 7C, and 7M includes a drum-shaped latent image bearing member 37 serving as an image bearing member in the center thereof. The latent image bearing member 37 can rotate in the direction of the arrow (clockwise). Each of the units 7K, 7Y, 7C, and 7M further includes a charging unit 39, an exposure unit 38, a developing unit 71, a cleaning unit (not shown), and a neutralization unit (not shown) around the latent image bearing member 37 from the upstream in the rotation direction of the latent image bearing member 37.

The charging unit 39 can uniformly charge the surface of the latent image bearing member 37 rotating in the direction of the arrow. The charging unit 39 may be any unit that can uniformly charge the surface of the latent image bearing member 37. The charging unit 39 may be of a non-contact charging type or a contact charging type. Specific examples of the charging unit include corona charging apparatuses, charging rollers, and charging brushes.

The surface potential (charge potential) of the latent image bearing member 37 is not particularly limited. In terms of the balance between developability and the charging ability of the latent image bearing member 37, the surface potential is preferably +200 to +500 V, more preferably +200 to +300 V. An excessively low surface potential may result in an insufficient development field and an unsatisfactory image density of a formed image. An excessively high surface potential may result in a dielectric breakdown of the latent image bearing member 37 and increased ozone generation.

The latent image bearing member 37 may be an inorganic photoconductor, for example, of amorphous silicon or an organic photoconductor that includes a photosensitive monolayer or multilayer containing an electric charge generating agent, a charge transport agent, and a binder resin on an electroconductive substrate.

The exposure unit 38 is a laser scanning unit and irradiates the latent image bearing member 37 uniformly charged by the charging unit 39 with a laser beam based on image data from a personal computer (PC) as a higher-level device, forms an electrostatic latent image based on the image data on the latent image bearing member 37. The developing unit 71 can supply the latent image bearing member 37 having the electrostatic latent image with the toner for developing electrostatic images according to an embodiment of the present disclosure, for forming a toner image based on the image data. Use of the toner according to an embodiment of the present disclosure can prevent toner adhesion to the developing rollers (sleeves) of the developing unit 71, thus forming high-quality images. The structure of the developing unit 71 depends on the type of developer and the development method. The toner image on the latent image bearing member 37 formed by the developing unit 71 is primarily transferred to the intermediate transfer belt 31 with a primary transfer roller 36 described below.

After the toner image is primarily transferred to the intermediate transfer belt 31, the residual toner on the latent image bearing member 37 is removed by the cleaning unit (not shown), if necessary.

The neutralization unit can remove electricity on the latent image bearing member 37 after the primary transfer. After cleaning by the cleaning unit and the neutralization unit, the latent image bearing member 37 is charged again by the charging unit 39.

The intermediate transfer belt 31 is an endless belt. The intermediate transfer belt 31 is looped over a plurality of rollers, such as a driving roller 33, a driven roller 34, a backup roller 35, and the first transfer rollers 36, such that the surface (the contact surface) of the intermediate transfer belt 31 abuts against the latent image bearing members 37. The intermediate transfer belt 31 rotates around the plurality of rollers while being pressed against the latent image bearing members 37 by the primary transfer rollers 36 opposite the latent image bearing members 37. The driving roller 33 is driven by a driving source (not shown), such as a stepping motor, and applies rotational driving force to the intermediate transfer belt 31. The driven roller 34, the backup roller 35, and the primary transfer rollers 36 can rotate with the intermediate transfer belt 31, which is driven by the driving roller 33. The rollers 34, 35, and 36 are driven via the intermediate transfer belt 31 by the driving roller 33 and support the intermediate transfer belt 31.

The primary transfer rollers 36 apply a first transfer bias to the intermediate transfer belt 31. The toner images on the latent image bearing members 37 are successively transferred to the intermediate transfer belt 31 in an overlapping manner, which is driven in the direction of the arrow (counterclockwise), between each of the latent image bearing members 37 and the corresponding primary transfer roller 36 (primary transfer).

The secondary transfer roller 32 applies a secondary transfer bias to a sheet P. The toner images primarily transferred to the intermediate transfer belt 31 are secondarily transferred to the sheet P between the secondary transfer roller 32 and the backup roller 35 (secondary transfer). Thus, a color transfer image (unfixed toner image) has been transferred to the sheet P.

The fixing unit 4 fixes the transfer image, which has been secondarily transferred to the sheet P in the image-forming section 3. The fixing unit 4 includes a heating roller 41, which is heated by an electric heating element, and a pressure roller 42. The pressure roller 42 is opposite the heating roller 41 and is pressed against the heating roller 41. The unfixed toner image transferred to the sheet P is softened by the heating roller 41 and is pressed with the pressure roller 42 to be fixed on the sheet P.

The transfer image transferred to the sheet P with the secondary transfer roller 32 in the image-forming section 3 is heated and pressed between the heating roller 41 and the pressure roller 42 to be fixed to the sheet P. The sheet P after fixing is ejected to the paper ejecting section 5. The color printer 1 according to an embodiment includes a plurality of conveying roller pairs 6 between the fixing unit 4 and the paper ejecting section 5.

The paper ejecting section 5 is formed by making a concave area on the top of the main body 1*a* of the color printer 1. A paper output tray 51 is located at the bottom of the concave area to receive a sheet P.

The color printer 1 forms an image on a sheet P through the image forming operation described above. Under certain fixing conditions, the image-forming apparatus having the fixing unit 4 including the heating roller 41 and the pressure roller 42 may have poor low-temperature fixability and cause high-temperature offset. Use of the toner for developing electrostatic images according to an embodiment of the present disclosure, however, results in excellent low-temperature fixability and prevents high-temperature offset.

EXAMPLES

The present disclosure will be further described in the following examples. The present disclosure is not limited to these examples.

Synthesis Examples

Synthesis of Polyester Resin A

A reaction vessel was charged with 30% by mole of a 2-mol ethylene oxide adduct of bisphenol A, 20% by mole of a 2-mol propylene oxide adduct of bisphenol A, 30% by mole of terephthalic acid, 10% by mole of dodecenylsuccinic anhydride, 4 g of a condensation catalyst (dibutyltin oxide), and 2 g of hydroquinone. In a nitrogen atmosphere, the mixture was allowed to react at 160° C. for five hours and 200° C. for five hours, and then at 200° C. for one hour at a pressure of 5 to 20 mmHg. The mixture was then allowed to react at 180° C. for one hour at a pressure of 8.3 kPa to yield an amorphous polyester resin A.

Synthesis of Polyester Resin B

A reaction vessel was charged with 30% by mole of a 2-mol ethylene oxide adduct of bisphenol A, 20% by mole of a 2-mol propylene oxide adduct of bisphenol A, 30% by mole of dimethyl terephthalate, and 10% by mole of trimellitic anhydride, and further with 4 g dibutyltin oxide and 2 g of hydroquinone. The mixture was allowed to react at 150° C. for two hours in a nitrogen atmosphere. 1,4-phenylenebisoxazoline constituting 10% by mole of the total monomers was then added to the reaction vessel and the mixture was allowed to react at 180° C. for 20 hours to yield a cross-linked polyester resin B.

Example 1

50 parts by mass of the polyester resin A, 50 parts by mass of the polyester resin B, 3 parts by mass of wax (a release agent, carnauba wax No. 1 manufactured by NOF Corp.), 5 parts by mass of carbon black (a colorant, MA-100 manufactured by Mitsubishi Chemical Corp.), and 1 part by mass of a charge control agent (P-51 manufactured by Orient Chemical Industries Co., Ltd.) were mixed in a Henschel mixer (20B manufactured by Nippon Coke & Engineering Co., Ltd.). The mixture was melt-kneaded in a twin-screw extruder (PCM-30 manufactured by Ikegai Corp.) at a material feed rate of 6 kg/h, a number of revolutions of 160 rpm, and a cylinder temperature of 120° C. and was then cooled to yield a kneaded product. The kneaded product was roughly pulverized in a pulverizer (Rotoplex 16/8 manufactured by Toa Kikai Seisakusho) and was finely pulverized in a pulverizer (Turbo Mill RS manufactured by Turbo Kogyo Co., Ltd.). The pulverized product was classified with Elbow-Jet (EJ-LABO EJ-L-3 manufactured by Nittetsu Mining Co., Ltd.) to yield toner base particles having a volume-average particle diameter of 8 μm. 100 parts by mass of the toner base particles, 1.0 part by mass of silica fine particles (RA-200 manufactured by Nippon Aerosil Co., Ltd.), and 0.8 parts by mass of silica fine particles (NA-50H manufactured by Nippon Aerosil Co., Ltd.) were mixed in a Henschel mixer (FM-20B manufactured by Nippon Coke & Engineering Co., Ltd.) at a number of revolutions of 2000 rpm and a jacket control temperature of 25° C. for 2 minutes to yield a toner of Example 1.

A content of a methyl ethyl ketone (MEK) insoluble material in the binder resin for use in the toner according to Example 1 was measured by the following method. TABLE 1 shows the content of the MEK insoluble material.

Measurement of Content of MEK Insoluble Material 50 parts by mass of the polyester resin A and 50 parts by mass of the polyester resin B were mixed in a Henschel mixer (FM-20B manufactured by Nippon Coke & Engineering Co., Ltd.). The mixture was melt-kneaded in a twin-screw extruder (PCM-30 manufactured by Ikegai Corp.) at a material feed rate of 6 kg/h, a number of revolutions of 160 rpm, and a cylinder temperature of 120° C. and was then cooled to yield a kneaded product. The kneaded product was roughly pulverized in a pulverizer (Rotoplex 16/8 manufactured by Toa Kikai Seisakusho) and was finely pulverized in a pulverizer (Turbo Mill RS manufactured by Turbo Kogyo Co., Ltd.). The pulverized product was classified with Elbow-Jet (EJ-LABO EJ-L-3 manufactured by Nittetsu Mining Co., Ltd.) to yield binder resin fine particles having a volume-average particle diameter of 8 μm. 2.0 g of the binder resin fine particles was immersed in 100 ml of methyl ethyl ketone (MEK) at 25° C. for 24 hours. The sample was then passed through a glass filter (aperture standard 11G-3). The filtrate of the sample was left still for 12 hours, and the supernatant liquid was collected. The supernatant liquid was dried at 60° C. under vacuum, and the residue after drying was weighed. The content of the MEK insoluble material in the binder resin was calculated using the following equation from the mass of the binder resin before immersion in MEK and the mass of the residue after drying. TABLE 1 shows the content of the MEK insoluble material in the toner of Example 1 with the amounts of polyester resin A and polyester resin B used, and the type and amount of wax in the toner of Example 1.

Content of MEK insoluble material in binder resin= (mass of binder resin before immersion in MEK− mass of residue after drying)/(mass of binder resin before immersion in MEK))×100

The viscoelasticity of the toner according to Example 1 was measured by the following method. TABLE 2 shows the results of the viscoelasticity measurement of the toner of Example 1, that is, tan δ at measurement temperatures of 75 to 200° C. in increments of 5° C. TABLE 2 does not include tan δ at a temperature of the breaking point or higher.

Viscoelasticity Measurement

The viscoelasticity was measured with a viscoelasticity measuring apparatus (Physica MCR301 manufactured by Anton Paar GmbH) using parallel plates having a diameter of 20 mm at a gap of 2 mm, a frequency of 10 Hz, a measurement temperature of 60 to 200° C., a heating rate of 2.5° C./min, and a shear stress of 500 Pa. A pellet of the toner according to Example 1 having a diameter of 20 mm and a thickness of 2.1 mm was used.

The low-temperature fixability, resistance to high-temperature offset (releasability), and heat-resistant storage stability of the toner according to Example 1 were measured by the following methods. TABLE 3 shows the results of low-temperature fixability, resistance to high-temperature offset, and heat-resistant storage stability of the toner of Example 1.

Method for Evaluating Low-Temperature Fixability

Preparation of Two-Component Developer

A two-component developer was prepared by mixing the toner obtained and a carrier for developers (a carrier for a multi-functional apparatus KM-C850 manufactured by Kyocera Mita Corp.) such that the toner content in the developer was 5% by mass of the carrier. The fixing test of the toner according to Example 1 was performed with KM-C850 using the two-component developer and the toner at different fixing temperatures. The fixability of the toner was evaluated by measuring the lowest fixing temperature (LFT) and the highest fixing temperature (HFT) in a rubbing test described below and calculating the fixing temperature width (FTW: the highest fixing temperature—the lowest fixing temperature). Fixability was considered to be OK when the fixing temperature width was 40° C. or more. The overall rating of the low-temperature fixability was considered to be OK when all of the fixing temperature width, the rubbing test described below, the lowest fixing temperature, and the highest fixing temperature were considered to be OK. These were evaluated with a fixing apparatus for use in the multi-functional apparatus (KM-C850) at linear velocities of 90 and 400 mm/s. An image to be fixed was output from the multi-functional apparatus (KM-C850) from which a fixing apparatus had been removed.

Rubbing Test

A solid image having an image density of 1.3 or more output by the multi-functional apparatus was rubbed with a 500-g weight covered with a textile at a number of double rubs of five while only a self-weight of the weight was added to the solid image. The image density after rubbing was measured. The image density was measured with GretagMacbeth SpectroEye (manufactured by GretagMacbeth). The fixing ratio was calculated using the following equation from the image density before and after rubbing.

$$\text{Fixing ratio (\%)} = (\text{Image density after rubbing}/\text{Image density before rubbing}) \times 100$$

Lowest Fixing Temperature and Highest Fixing Temperature

The lowest fixing temperature was the lowest temperature at which the fixing ratio in the rubbing test was 90% or more and no cold offset occurred. The lowest fixing temperature of 150° C. or less was considered to be OK. The highest fixing temperature was the highest temperature at which the fixing ratio in the rubbing test was 90% or more and no hot offset occurred. The highest fixing temperature of 180° C. or more was considered to be OK.

Evaluation of Releasability (Resistance to High-Temperature Offset)

An unfixed image 50 mm long and 160 mm wide was formed in a front margin of 5 mm using a multi-functional apparatus (KM-C850 manufactured by Kyocera Mita Corp.) including a fixing test machine, which included an external drive and a fixing temperature controller, as a fixing apparatus (fixing unit) for the evaluation of releasability. After the amount of toner on a paper sheet was measured, the unfixed image was passed through the fixing test machine at a fixing temperature of 180° C. and a linear velocity of 97 mm/s. The amount of toner was changed in increments of 0.1 mg/cm$^2$. The amount of toner (mg/cm$^2$) at which a paper sheet did not wind around a fixing roller was considered to be the amount of toner releasable. Releasability was evaluated in accordance with the following criteria. The following are evaluation criteria for releasability.

OK: Amount of toner of 1.5 mg/cm$^2$ or more.

NG: Amount of toner of less than 1.5 mg/cm$^2$.

Evaluation of Heat-Resistant Storage Stability

Five grams of toner was stored at 58° C. for 24 hours and was then cooled to room temperature. The cooled toner was filtered through a 400-mesh sieve using Powder Tester (manufactured by Hosokawa Micron Corp.) at a vibration level of 5. The heat-resistant storage stability was considered to be OK when the residual toner on the sieve was less than 60% by mass and NG when the residual toner was 60% or more.

Example 2

The toner of Example 2 was prepared in the same manner as in Example 1 except that the amount of polyester resin A was 60 parts by mass, and the amount of polyester resin B was 40 parts by mass. TABLE 1 shows the content of the MEK insoluble material in the toner of Example 2, in addition to the amounts of polyester resin A and polyester resin B used, and the type and amount of wax in the toner of Example 2. TABLE 2 shows the results of the viscoelasticity measurement of the toner of Example 2. TABLE 3 shows the evaluation results of low-temperature fixability, resistance to high-temperature offset, and heat-resistant storage stability of the toner of Example 2.

Example 3

The toner of Example 3 was prepared in the same manner as in Example 1 except that the amount of polyester resin A was 70 parts by mass, and the amount of polyester resin B was 30 parts by mass. TABLE 1 shows the content of the MEK insoluble material in the toner of Example 3, in addition to the amounts of polyester resin A and polyester resin B used, and the type and amount of wax in the toner of Example 3. TABLE 2 shows the results of the viscoelasticity measurement of the toner of Example 3. TABLE 3 shows the evaluation results of low-temperature fixability, resistance to high-temperature offset, and heat-resistant storage stability of the toner of Example 3.

Example 4

The toner of Example 4 was prepared in the same manner as in Example 1 except that the amount of polyester resin A was 40 parts by mass, and the amount of polyester resin B was 60 parts by mass. TABLE 1 shows the content of the MEK insoluble material in the toner of Example 4, in addition to the amounts of polyester resin A and polyester resin B used, and the type and amount of wax in the toner of Example 4. TABLE 2 shows the results of the viscoelasticity measurement of the toner of Example 4. TABLE 3 shows the evaluation results of low-temperature fixability, resistance to high-temperature offset, and heat-resistant storage stability in the toner of Example 4.

Example 5

The toner of Example 5 was prepared in the same manner as in Example 1 except that the amount of polyester resin A was 30 parts by mass, and the amount of polyester resin B was 70 parts by mass. TABLE 1 shows the content of the MEK insoluble material in the toner of Example 5, in addition to the amounts of polyester resin A and polyester resin B used, and the type and amount of wax in the toner of Example 5. TABLE 2 shows the results of the viscoelasticity measurement of the toner of Example 5. TABLE 3 shows the evaluation results of low-temperature fixability, resistance to high-temperature offset, and heat-resistant storage stability of the toner of Example 5.

Example 6

The toner of Example 6 was prepared in the same manner as in Example 1 except that the amount of carnauba wax was 10 parts by mass. TABLE 1 shows the content of the MEK insoluble material in the toner according to Example 6, in addition to the amounts of polyester resin A and polyester resin B used, and the type and amount of wax in the toner according to Example 6. TABLE 2 shows the results of the viscoelasticity measurement of the toner according to Example 6. TABLE 3 shows the evaluation results of low-temperature fixability, resistance to high-temperature offset, and heat-resistant storage stability of the toner according to Example 6.

Example 7

The toner of Example 7 was prepared in the same manner as in Example 1 except that the amount of carnauba wax was 20 parts by mass. TABLE 1 shows the content of the MEK insoluble material in the toner of Example 7, in addition to the amounts of polyester resin A and polyester resin B used, and the type and amount of wax in the toner of Example 7. TABLE 2 shows the results of the viscoelasticity measurement of the toner of Example 7. TABLE 3 shows the evaluation results of low-temperature fixability, resistance to high-temperature offset, and heat-resistant storage stability of the toner of Example 7.

Example 8

The toner of Example 8 was prepared in the same manner as in Example 1 except that the carnauba wax was replaced with a synthetic ester wax (WEP-3 manufactured by NOF Corp.). TABLE 1 shows the content of the MEK insoluble material in the toner of Example 8, in addition to the amounts of polyester resin A and polyester resin B used, and the type and amount of wax in the toner of Example 8. TABLE 2 shows the results of the viscoelasticity measurement of the toner of Example 8. TABLE 3 shows the evaluation results of low-temperature fixability, resistance to high-temperature offset, and heat-resistant storage stability of the toner of Example 8.

Example 9

The toner of Example 9 was prepared in the same manner as in Example 1 except that the carnauba wax was replaced with hydroxy group modified paraffin wax (hydroxy group modified FT-105 manufactured by Nippon Seiro Co., Ltd.). TABLE 1 shows the content of the MEK insoluble material in the toner of Example 9, in addition to the amounts of polyester resin A and polyester resin B used, and the type and amount of wax in the toner of Example 9. TABLE 2 shows the results of the viscoelasticity measurement of the toner of Example 9. TABLE 3 shows the evaluation results of low-temperature fixability, resistance to high-temperature offset, and heat-resistant storage stability of the toner of Example 9.

Comparative Example 1

The toner of Comparative Example 1 was prepared in the same manner as in Example 1 except that the amount of polyester resin A was 20 parts by mass, and the amount of polyester resin B was 80 parts by mass. TABLE 1 shows the content of the MEK insoluble material in the toner of Comparative Example 1, in addition to the amounts of polyester resin A and polyester resin B used, and the type and amount of wax in the toner of Comparative Example 1. TABLE 2 shows the results of the viscoelasticity measurement of the toner of Comparative Example 1. TABLE 3 shows the evaluation results of low-temperature fixability, resistance to high-temperature offset, and heat-resistant storage stability of the toner of Comparative Example 1.

Comparative Example 2

The toner of Comparative Example 2 was prepared in the same manner as in Example 1 except that the amount of polyester resin A was 80 parts by mass, and the amount of polyester resin B was 20 parts by mass. TABLE 1 shows the content of the MEK insoluble material in the toner of Comparative Example 2, in addition to the amounts of polyester resin A and polyester resin B used, and the type and amount of wax in the toner of Comparative Example 2. TABLE 2 shows the results of the viscoelasticity measurement of the toner of Comparative Example 2. TABLE 3 shows the evaluation results of low-temperature fixability, resistance to high-temperature offset, and heat-resistant storage stability of the toner of Comparative Example 2.

Comparative Example 3

The toner of Comparative Example 3 was prepared in the same manner as in Example 1 except that the wax was paraffin wax not modified with a hydroxy group (FT-105 manufactured by Nippon Seiro Co., Ltd.). TABLE 1 shows the content of the MEK insoluble material in the toner of Comparative Example 3, in addition to the amounts of polyester resin A and polyester resin B used, and the type and amount of wax in the toner of Comparative Example 3. TABLE 2 shows the results of the viscoelasticity measurement of the toner of Comparative Example 3. TABLE 3 shows the evaluation results of low-temperature fixability, resistance to high-temperature offset, and heat-resistant storage stability in the toner of Comparative Example 3.

TABLE 1

| | | | Wax | | Content of MEK |
|---|---|---|---|---|---|
| | Resin A (parts by mass) | Resin B (parts by mass) | Type | Amount (parts by mass) | Insoluble Material (% by mass) |
| Example 1 | 50 | 50 | Carnauba Wax No. 1 | 3 | 35 |
| Example 2 | 60 | 40 | Carnauba Wax No. 1 | 3 | 28 |
| Example 3 | 70 | 30 | Carnauba Wax No. 1 | 3 | 21 |
| Example 4 | 40 | 60 | Carnauba Wax No. 1 | 3 | 42 |

TABLE 1-continued

| | Resin A (parts by mass) | Resin B (parts by mass) | Wax Type | Wax Amount (parts by mass) | Content of MEK Insoluble Material (% by mass) |
|---|---|---|---|---|---|
| Example 5 | 30 | 70 | Carnauba Wax No. 1 | 3 | 49 |
| Example 6 | 70 | 30 | Carnauba Wax No. 1 | 10 | 21 |
| Example 7 | 70 | 30 | Carnauba Wax No. 1 | 20 | 21 |
| Example 8 | 70 | 30 | WEP-3 | 3 | 21 |

TABLE 1-continued

| | Resin A (parts by mass) | Resin B (parts by mass) | Wax Type | Wax Amount (parts by mass) | Content of MEK Insoluble Material (% by mass) |
|---|---|---|---|---|---|
| Example 9 | 70 | 30 | Hydroxy Group Modified FT-105 | 3 | 21 |
| Comparative Example 1 | 20 | 80 | Carnauba Wax No. 1 | 3 | 56 |
| Comparative Example 2 | 80 | 20 | Carnauba Wax No. 1 | 3 | 14 |
| Comparative Example 3 | 70 | 30 | FT-105 | 3 | 21 |

TABLE 2

| Temperature (° C.) | tan δ Example 1 | 2 | 3 | 4 | 5 | 6 | 7 | 8 | 9 | Comparative Example 1 | 2 | 3 |
|---|---|---|---|---|---|---|---|---|---|---|---|---|
| 75 | 1.01 | 1.09 | 0.98 | 1.00 | 1.65 | 1.09 | 1.07 | 0.98 | 0.92 | 2.15 | 1.01 | 0.92 |
| 80 | 1.22 | 1.28 | 1.42 | 1.24 | 1.22 | 1.52 | 1.54 | 1.42 | 1.42 | 1.24 | 1.22 | 1.42 |
| 85 | 1.26 | 1.29 | 1.46 | 1.25 | 1.25 | 1.61 | 1.61 | 1.46 | 1.43 | 0.61 | 1.27 | 1.43 |
| 90 | 1.31 | 1.33 | 1.47 | 1.30 | 1.32 | 1.64 | 1.65 | 1.47 | 1.48 | 0.63 | 1.36 | 1.48 |
| 95 | 1.40 | 1.41 | 1.49 | 1.42 | 1.41 | 1.64 | 1.66 | 1.49 | 1.50 | 0.71 | 1.42 | 1.50 |
| 100 | 1.45 | 1.50 | 1.51 | 1.47 | 1.48 | 1.68 | 1.65 | 1.51 | 1.51 | 0.75 | 1.57 | 1.51 |
| 105 | 1.52 | 1.63 | 1.66 | 1.51 | 1.36 | 1.72 | 1.70 | 1.68 | 1.55 | 0.79 | 1.62 | 1.63 |
| 110 | 1.55 | 1.78 | 1.77 | 1.58 | 1.31 | 1.77 | 1.72 | 1.72 | 1.59 | 0.84 | 1.75 | 1.63 |
| 115 | 1.57 | 1.82 | 1.86 | 1.59 | 1.28 | 1.86 | 1.80 | 1.77 | 1.62 | 0.88 | 1.83 | 1.65 |
| 120 | 1.60 | 1.83 | 1.90 | 1.62 | 1.32 | 1.90 | 1.81 | 1.86 | 1.63 | 0.97 | 1.98 | 1.67 |
| 125 | 1.63 | 1.82 | 1.91 | 1.66 | 1.41 | 1.91 | 1.91 | 1.90 | 1.65 | 1.03 | 2.04 | 1.65 |
| 130 | 1.66 | 1.84 | 1.88 | 1.69 | 1.41 | 1.88 | 1.90 | 1.91 | 1.67 | 1.14 | 2.27 | 1.59 |
| 135 | 1.71 | 1.81 | 1.82 | 1.73 | 1.44 | 1.82 | 1.85 | 1.85 | 1.59 | 1.28 | 2.40 | 1.55 |
| 140 | 1.67 | 1.78 | 1.71 | 1.67 | 1.50 | 1.71 | 1.85 | 1.70 | 1.55 | 1.37 | 2.48 | 1.54 |
| 145 | 1.65 | 1.85 | 1.63 | 1.68 | 1.54 | 1.63 | 1.86 | 1.69 | 1.63 | 1.25 | 2.49 | 1.81 |
| 150 | 1.82 | 2.81 | 2.22 | 1.81 | 1.63 | 4.88 | 2.01 | 2.21 | 2.52 | 1.11 | 4.37 | 2.37 |
| 155 | 2.44 | 4.99 | 4.05 | 2.97 | 2.02 | 6.23 | 5.90 | 4.09 | 4.85 | 1.22 | 6.97 | 4.70 |
| 160 | 4.81 | 6.27 | 7.69 | 4.65 | 2.65 | 8.10 | 9.11 | 7.70 | 8.77 | 1.37 | 8.05 | 9.12 |
| 165 | 6.21 | 8.12 | — | 6.82 | 4.33 | — | — | — | — | 1.43 | 10.25 | — |
| 170 | 8.32 | — | — | 8.20 | 5.01 | — | — | — | — | 1.57 | — | — |
| 175 | — | — | — | 10.16 | 7.82 | — | — | — | — | 1.65 | — | — |
| 180 | — | — | — | — | 11.20 | — | — | — | — | 2.62 | — | — |
| 185 | — | — | — | — | — | — | — | — | — | 4.51 | — | — |
| 190 | — | — | — | — | — | — | — | — | — | 6.14 | — | — |
| 195 | — | — | — | — | — | — | — | — | — | 7.68 | — | — |
| 200 | — | — | — | — | — | — | — | — | — | — | — | — |

TABLE 3

| | Fixability 90 mm/s LFT (° C.) | HFT (° C.) | FTW (° C.) | 400 mm/s LFT (° C.) | HFT (° C.) | FTW (° C.) | Overall Rating | Releasability ($mg/cm^2$) | HRSS (%) |
|---|---|---|---|---|---|---|---|---|---|
| Example 1 | 140 | 200 | 60 | 145 | 195 | 50 | OK | 1.8/OK | 20/OK |
| Example 2 | 135 | 185 | 50 | 140 | 180 | 40 | OK | 1.7/OK | 30/OK |
| Example 3 | 130 | 180 | 50 | 135 | 175 | 40 | OK | 1.5/OK | 40/OK |
| Example 4 | 145 | 205 | 60 | 155 | 200 | 45 | OK | 1.8/OK | 5/OK |
| Example 5 | 150 | 205 | 55 | 160 | 200 | 40 | OK | 2.0/OK | 5/OK |
| Example 6 | 125 | 180 | 55 | 130 | 180 | 50 | OK | 2.2/OK | 45/OK |
| Example 7 | 125 | 180 | 55 | 130 | 180 | 50 | OK | 2.5 or more/OK | 50/OK |
| Example 8 | 130 | 180 | 50 | 135 | 175 | 40 | OK | 1.7/OK | 45/OK |
| Example 9 | 130 | 180 | 50 | 135 | 175 | 40 | OK | 1.5/OK | 30/OK |
| Comparative Example 1 | 160 | 210 | 50 | 165 | 200 | 35 | NG | 1.4/NG | 5/OK |
| Comparative Example 2 | 120 | 160 | 40 | 125 | 155 | 30 | NG | 1.2/NG | 75/NG |

TABLE 3-continued

| | Fixability | | | | | | | | |
|---|---|---|---|---|---|---|---|---|---|
| | 90 mm/s | | | 400 mm/s | | | | | |
| | LFT (° C.) | HFT (° C.) | FTW (° C.) | LFT (° C.) | HFT (° C.) | FTW (° C.) | Overall Rating | Releasability ($mg/cm^2$) | HRSS (%) |
| Comparative Example 3 | 130 | 180 | 50 | 135 | 175 | 40 | OK | 1.3/NG | 70/NG |

In accordance with Examples 1 to 9, the toner contains a binder resin, a colorant, a release agent, and a charge control agent, the release agent contains a wax having a polar group, tan δ of the toner at 80 to 145° C. measured with a viscoelasticity measuring apparatus at a frequency of 10 Hz and a shear stress of 500 Pa is 1 to 2, and the toner has a breaking point of 180° C. or less in a temperature-tan δ curve. Such a toner for developing electrostatic images has excellent low-temperature fixability, resistance to high-temperature offset, and heat-resistant storage stability.

The toner of Comparative Example 1 has tan δ of less than 1 at temperature of 80 to 145° C. and a breaking point of 180° C. or more in a temperature-tan δ curve. Thus, the toner of Comparative Example 1 is difficult to soften at low temperature and has high viscosity at high temperature. Thus, the toner of Comparative Example 1 has excellent heat-resistant storage stability, but has a high value of lowest fixing temperature, poor low-temperature fixability, and poor releasability, thus often causing high-temperature offset.

The toner of Comparative Example 2 had much higher tan δ than toners of Examples at temperature of 80 to 145° C. Thus, the viscoelasticity of the toner of Comparative Example 2 varies greatly with temperature at 80 to 145° C. With the toner of Comparative Example 2, therefore, a toner image can be fixed in a narrow temperature range. The toner of Comparative Example 2 has higher tan δ than the toners of Examples at 145 to 150° C. and high viscosity around this temperature range. Thus, the toner of Comparative Example 2 has poor releasability, often causes high-temperature offset, and has poor heat-resistant storage stability.

The toner of Comparative Example 3 contains a wax having no polar group as a component of the release agent. Thus, the toner of Comparative Example 3 has a low affinity between the binder resin and the release agent, and the binder resin and the release agent tend to separate at high temperature, resulting in poor releasability. The wax having no polar group tends to bleed from the binder resin at high temperature because of its low affinity for the binder resin. Thus, the toner of Comparative Example 3 has poor heat-resistant storage stability.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A toner for developing electrostatic images, manufactured by mixing a binder resin with a colorant, a charge control agent, a release agent, and melt-kneading, the resulting mixture comprising:

the binder resin, the colorant, the release agent, and the charge control agent;

the binder resin is a polyester resin, wherein the polyester resin is a mixture of an amorphous polyester resin and a cross-linked polyester resin and the ratio of the amorphous polyester resin to the cross-linked polyester resin is from 30:70 to 50:50;

the release agent contains a wax having a polar group; and the toner for developing electrostatic images has tan δ of 1 to 2 at a temperature of 80 to 145° C. as measured with a viscoelasticity measuring apparatus at a frequency of 10 Hz and a shear stress of 500 Pa, and has a breaking point of 180° C. or less in a temperature-tan δ curve.

2. The toner for developing electrostatic images according to claim 1, wherein the amount of the wax having a polar group is 20 parts by mass or less per 100 parts by mass of the binder resin.

3. The toner for developing electrostatic images according to claim 1, wherein the cross-linked polyester resin is a resin having a group represented by the chemical formula (1) in its molecular chain, and methyl ethyl ketone insoluble material constitutes 15 to 50% by mass of the binder resin

—CO—N< (1).

4. The toner for developing electrostatic images according to claim 3, wherein the cross-linked polyester resin is produced by a reaction between a copolymer and a bisoxazoline compound having the chemical formula (2), the copolymer being a copolymer of a carboxylic acid component comprising a trivalent or higher valent carboxylic acid component and an alcohol component

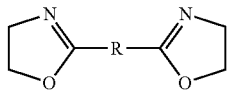

(2)

(wherein R denotes a phenylene group or an alkylene group having 1 to 6 carbon atoms).

5. A method for forming images with an image-forming apparatus using a toner for developing electrostatic images comprising using as the image-forming apparatus an apparatus comprising: an image-forming section for transferring a toner image, a heating roller for heating a recorded medium to which the toner image has been transferred, and a pressure roller for pressing the recorded medium, the pressure roller being opposite the heating roller, using as the toner, toner comprising a binder resin, a colorant, a release agent, and a charge control agent, the toner is manufactured by mixing the binder resin with a colorant, a charge control agent, a release agent, and melt-kneading the resulting mixture, the binder resin is a polyester resin, wherein the polyester resin is a mixture of an amorphous polyester resin and a cross-linked polyester resin and the ratio of the amorphous polyester resin to the cross-linked polyester resin is from 30:70 to 50:50, the release agent contains a wax having a polar group, and the toner has tan δ of 1 to 2 at a temperature of 80 to 145° C. as measured with a viscoelasticity measuring apparatus at a frequency of 10 Hz and a shear stress of 500 Pa, and has a breaking point of 180° C. or less in a temperature-tan δ curve; and forming images with the image forming apparatus.

6. The toner for developing electrostatic images according to claim 1, wherein the ratio of the amorphous polyester resin to the cross-linked polyester resin is from 30:70 to 40:60.

7. The method according to claim 5, wherein the ratio of the amorphous polyester resin to the cross-linked polyester resin is from 30:70 to 40:60.

* * * * *